US010814156B2

(12) United States Patent
Herranen et al.

(10) Patent No.: US 10,814,156 B2
(45) Date of Patent: Oct. 27, 2020

(54) ARRANGEMENT AND METHOD FOR ADJUSTING LOAD IN TRAINING EQUIPMENT

(71) Applicant: Omnigym Oy, Turku (FI)

(72) Inventors: Juhani Herranen, Oulu (FI); Ari Koponen, Outokumpu (FI); Jari Rännälä, Espoo (FI)

(73) Assignee: OMNIGYM OY, Turku (FI)

( * ) Notice: Subject to any disclaimer, the term of this patent is extended or adjusted under 35 U.S.C. 154(b) by 56 days.

(21) Appl. No.: 15/756,325

(22) PCT Filed: Aug. 29, 2016

(86) PCT No.: PCT/FI2016/050591
§ 371 (c)(1),
(2) Date: Feb. 28, 2018

(87) PCT Pub. No.: WO2017/037337
PCT Pub. Date: Mar. 9, 2017

(65) Prior Publication Data

US 2018/0243604 A1 Aug. 30, 2018

(30) Foreign Application Priority Data

Aug. 31, 2015 (FI) ..... 20155623

(51) Int. Cl.
*A63B 21/06* (2006.01)
*A63B 21/00* (2006.01)
(Continued)

(52) U.S. Cl.
CPC .... *A63B 21/0616* (2015.10); *A63B 21/00069* (2013.01); *A63B 21/0615* (2013.01);
(Continued)

(58) Field of Classification Search
CPC ..... A63B 21/0615–0616; A63B 21/1519
See application file for complete search history.

(56) References Cited

U.S. PATENT DOCUMENTS 3,573,865 A 4/1971 Annas et al.
5,344,374 A * 9/1994 Telle ..... A63B 21/00072 482/112
(Continued)

FOREIGN PATENT DOCUMENTS

DE 202013104706 U1 1/2014
EP 0617986 A1 10/1994
(Continued)

OTHER PUBLICATIONS

International Search Report for Application No. PCT/FI2016/050591 dated Nov. 18, 2016, 4 pages.
(Continued)

*Primary Examiner* — Jennifer Robertson
(74) *Attorney, Agent, or Firm* — Alston & Bird LLP

(57) ABSTRACT

The invention concerns an arrangement for adjusting load in training equipment. The arrangement comprises a load unit, an elongated guideway along which the load unit is arranged to move, a locking device with which the load unit is secured into a position corresponding the desired load of the training equipment, and a connector with which the guideway is pivotally connected to the training equipment via a fulcrum. The guideway is connected both to the moving arm and to a frame of the training equipment via the fulcrum. The invention further concerns a method for adjusting load in training equipment.

11 Claims, 2 Drawing Sheets

(51) Int. Cl.
*A63B 21/078* (2006.01)
*A63B 23/12* (2006.01)

(52) U.S. Cl.
CPC ..... *A63B 21/4047* (2015.10); *A63B 21/0783* (2015.10); *A63B 21/4043* (2015.10); *A63B 23/1209* (2013.01)

(56) References Cited

U.S. PATENT DOCUMENTS

| | | | | |
|---|---|---|---|---|
| 6,074,328 | A * | 6/2000 | Johnson | A63B 21/0615 482/137 |
| 7,331,908 | B2 * | 2/2008 | Olsen | A63B 21/0628 482/101 |
| 2014/0336013 | A1 | 11/2014 | Alimov et al. | |
| 2015/0148200 | A1 | 5/2015 | Miller | |

FOREIGN PATENT DOCUMENTS

| | | | |
|---|---|---|---|
| EP | 0643983 | A1 | 3/1995 |
| ES | 21529895 | A1 | 2/2001 |
| FR | 2 767 707 | A1 | 3/1999 |
| WO | WO 9626764 | A1 | 9/1996 |
| WO | WO 03/020374 | A1 | 3/2003 |
| WO | WO 2008/007168 | A2 | 1/2008 |

OTHER PUBLICATIONS

Search Report for Finnish Application No. 20155623 dated Nov. 26, 2015, 2 pages.

* cited by examiner

ARRANGEMENT AND METHOD FOR ADJUSTING LOAD IN TRAINING EQUIPMENT

CROSS-REFERENCE TO RELATED APPLICATIONS

This application is a national phase entry of International Application No. PCT/FI2016/050591, filed Aug. 29, 2016, which claims priority to Finnish Patent Application No. 20155623, filed on Aug. 31, 2015, the entire contents of which are incorporated herein by reference.

TECHNICAL FIELD

The present disclosure relates to an arrangement and a method for adjusting load in training equipment. Particularly, the invention relates to adjusting load in training equipment with a monolithic weight, especially in training equipment situated outdoors.

BACKGROUND OF THE INVENTION

Load adjustment in training equipment is typically achieved by weight plates or other removable, stackable or otherwise attachable loose, disconnectedly organized weight units. These kinds of solutions are habitually utilized in gyms and other indoor training facilities. In outdoor equipment, there are typically no specific arrangements or methods for load adjustment. Instead, the load is derivable from the user of the equipment, either directly from the weight of the user, the weight of the moving parts of the equipment, or by for example, adjusting the length of a torque arm by gripping it from different positions along the arm. This places serious limitations to the load adjustment of the training equipment, and may inhibit users for utilizing pieces of equipment when the fixed load is not suitable for them.

On the other hand, weight plates and other such loose or removable weights are not suited for use in outdoor training equipment. Apart from storing, changing and maintenance issues, safety issues restrict their use in outdoor training equipment. Also indoors, these kinds of weights for loading training equipment may cause accidents to the users. Furthermore, changing loose weights or weight plates is time-consuming and can be even difficult for users with impaired abilities or simply less strength.

European standard EN 16630 concerning permanently installed, freely accessible outdoor fitness equipment specifies general safety requirements for the manufacture, installation, inspection and maintenance of the equipment. Loose weights such that are commonly used in indoor training equipment, such as weight training equipment in gyms, are not allowed in equipment intended for outdoor use according to EN 16630. Therefore, training equipment installed outdoors must have either monolithic, undividable weights for creating the load, employ other load adjustment arrangements, or function without any adjustable load or weight arrangements. The latter naturally limits the utilization of such equipment.

SUMMARY OF THE INVENTION

An objective of the present invention is to provide an improved arrangement for adjusting load in training equipment, and a method for the same. The arrangement and the method is in particular, but not only, intended for training equipment fitted with a monolithic or undividable weight, for example for outdoor weight training equipment with at least one movable arm. However, the arrangement and the method are equally suitable for indoor use, and for training equipment of numerous different configurations.

The arrangement for adjusting load in training equipment comprising at least one moving arm pivotably connected to a frame presented here is characterized by comprising at least one load unit, an elongated guideway extending to both sides of a fulcrum and along which the load unit is arranged to move, a locking device with which the load unit is secured into a position corresponding the desired load of the training equipment, and a connector with which the guideway is pivotally connected to the training equipment via the fulcrum. The guideway is connected both to the moving arm and to the frame of the training equipment via the fulcrum. The load unit is movable along the guideway to a locking position on either side of the fulcrum.

In one embodiment of the invention, the load unit comprises a monolithic weight, at least one actuator with which the load unit is moved along the guideway, and a cover.

In one embodiment of the invention, the locking device is arranged directly onto the load unit.

In one embodiment of the invention, the locking device comprises a gripping part with which the load unit is manually moved along the guideway, an arm arranged to extend inside the load unit through the cover, an attaching element with which the arm is attached pivotably to the cover, and an end part at the end of the arm, the end part attachable into a counterpart arranged on the guideway.

In another embodiment, the end part and the counterpart form a form-lock when the load unit is secured into a position.

In yet another embodiment, the counterparts are a series of pre-determined locking positions corresponding to the desired load of the training equipment.

In another embodiment, the locking device is spring-loaded so that the end part is automatically secured into one counterpart in case the locking device is unintentionally set into a position between two adjacent counterparts.

In another aspect of the invention, there is disclosed a method for adjusting load in training equipment characterized by comprising at least one moving arm pivotably connected to a frame, at least one load unit, an elongated guideway extending to both sides of the fulcrum through which the guideway and the moving arm are connected to the frame, and along which the load unit is arranged to move, a locking device with which the load unit is secured into a position corresponding the desired load of the training equipment, and a connector with which the guideway is connected pivotally to the training equipment via a fulcrum; and further characterized in the load unit is moved on the guideway to a locking position on either side of the fulcrum.

In one embodiment of the invention, the load unit is secured to a pre-determined locking position arranged onto the guideway to adjust the load in stepwise manner within the pre-determined locking positions.

The invention according to the present disclosure offers specific advantages over prior art.

The disclosed arrangement for adjusting load in training equipment has a simple structure which makes it straightforward to manufacture, install and maintain once in use. The arrangement and method are easy to utilize. Safety requirements are fulfilled.

The disclosed arrangement enables adjusting the load of training equipment so that a relatively small change in length of a torque arm causes a significant change in load.

This enables efficient and user-specific weight training. Also the dimensions of the training equipment can be kept relatively small, and the equipment can be installed in places where only limited space is available.

BRIEF DESCRIPTION OF DRAWINGS

The accompanying drawings, which are included to provide a further understanding of the invention, and which constitute a part of this specification, illustrate embodiments of the invention. Together with the description the drawings are meant to help to explain the principles of the invention. The invention is not limited to the specific embodiments illustrated in the drawings.

In the drawings.

The following reference symbols have been used to annotate different parts of the invention throughout the figures:

| | |
|---|---|
| 1 | training equipment unit |
| 10 | moving arm |
| 11 | frame |
| 12 | seat |
| 120 | foot of the seat |
| 13 | lower support frame |
| 14 | handles |
| 15 | support arm |
| 2, 2b | load unit |
| 21 | weight |
| 22 | actuator |
| 23 | cover |
| 3, 3b | guideway |
| 35a-e | counterparts/locking positions |
| 4 | connector |
| 5 | locking device |
| 51 | gripping part |
| 52 | arm |
| 53 | attaching element |
| 54 | end part |
| 6 | fulcrum |
| 61 | first side of the fulcrum |
| 62 | second side of the fulcrum |

DETAILED DESCRIPTION OF THE EMBODIMENTS

Figure 1:
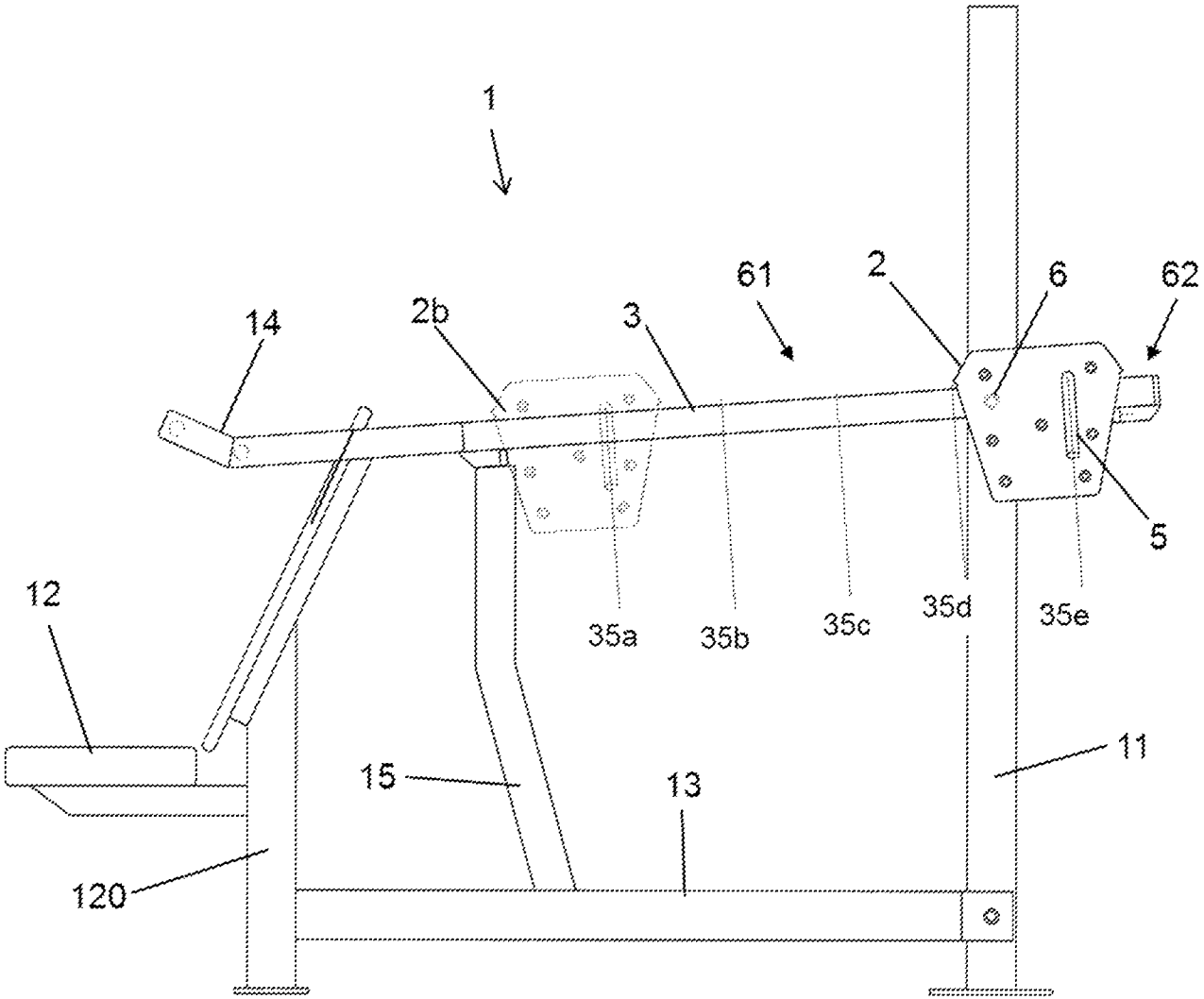
FIG. 1 presents a schematic side view of an arrangement for adjusting load in training equipment in one embodiment according to the present disclosure.

FIG. 1 presents a piece of training equipment 1, more specifically a front press type strength training unit comprising a seat 12, its foot 120, a frame 11 which in this embodiment is a vertical frame, a lower support frame 13, a moving arm 10 (in FIG. 1 flush behind a guideway 3 and therefore not directly visible), handles 14 arranged onto the moving arm 10 and the guideway 3, a support arm 15 for the moving arm and a load unit 2. The specific frame structure of the different training equipment units naturally depends on the type of exercise for which it is intended.

Typically, the frame structure 10, 11, 12, 13, 120, 14, 15 of the training equipment is constructed of tubular steel tubes or pipes, bars, beams or similar elongated hollow pieces with either round, square, rectangular or other cross-sections. The pieces may also be solid. Also aluminum, wood or any wood-based material, or engineered composite materials such as plastic composites or any such durable materials are conceivable for the aforementioned structures.

In the embodiment of FIG. 1, the support arm 15 is arranged to receive the moving arm 10 and the guideway 3 at the start-off of the weight training movement so that the moving arm 10, the guideway 3 or the handles 14 do not hit or hurt the user should their grip from the handles slip. The movement of the training equipment unit 1 or its trajectory is therefore restricted by the support arm 15 on one end, and on the other end, by the user, or by a mechanical or structural restrictor or stop.

In the embodiment presented in FIG. 1, the training equipment unit 1 comprises a vertical frame 11 to which the guideway 3 and the moving arm 10 are pivotably connected via a common fulcrum 6 by any suitable connector. The connector can for example be a bar or a rod, extending from the guideway 3 through the frame 11 to the moving arm 10, bearing-mounted on the moving arm 10, the guideway 3 and the frame 11, such as the one depicted in FIG. 2. Other possible connectors enabling a pivotable or hinged connection through a common fulcrum or hub are conceivable.

The guideway 3 is an elongated structures made from the same type of material as the frame parts. The guideway 3 may for example be a hollow metal rod made from steel or other metal, such as aluminum. It can also be made from wood or plastic or any other suitable durable material. The guideway 3 is connected both to the frame 11 and to the moving arm 10 via the common fulcrum 6 as described previously. The guideway 3 extends to both sides 61, 62 of the fulcrum 6.

Figure 2:
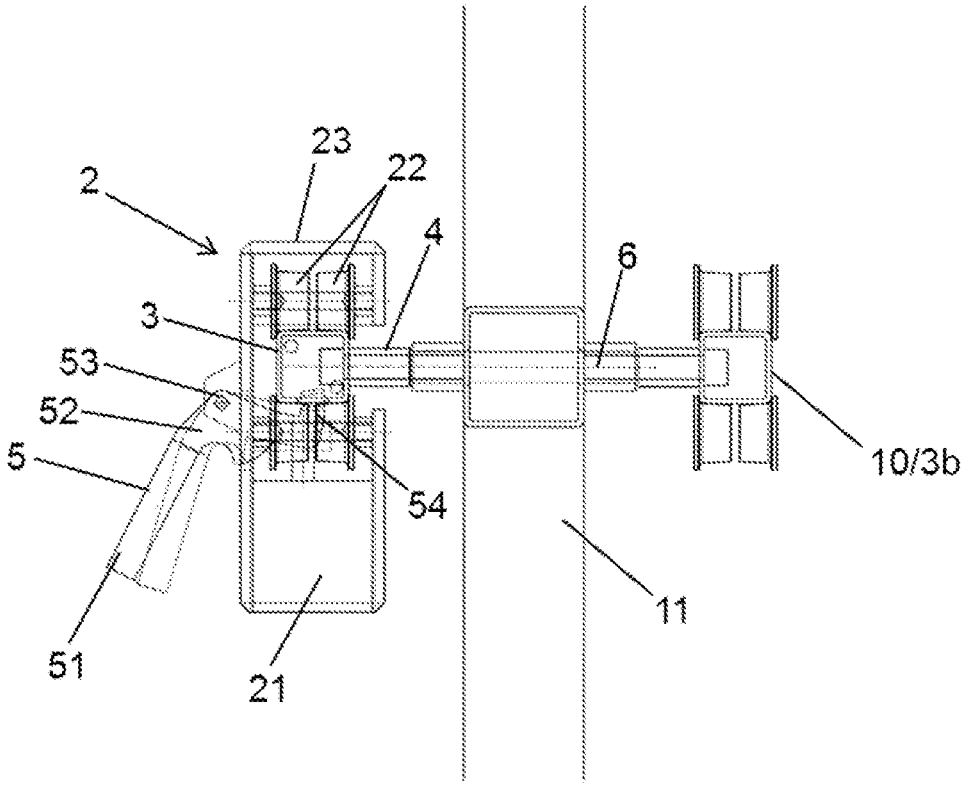
FIG. 2 presents a schematic, partially sectional overview of an embodiment of the arrangement according to the present disclosure, where the arrangement is viewed from behind the training equipment.
Figure 3:
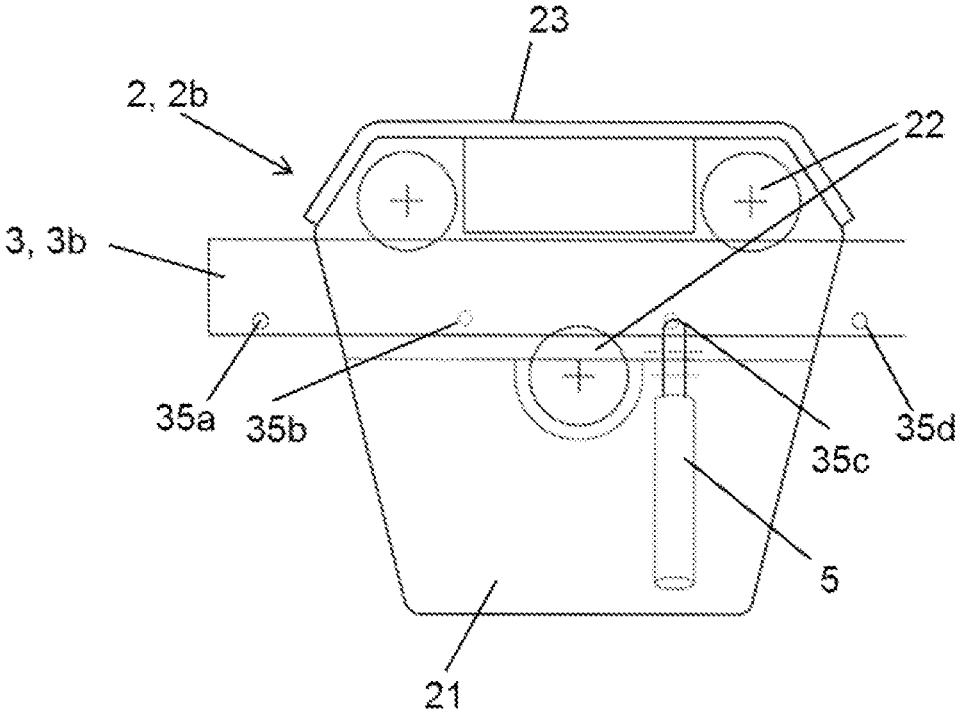
FIG. 3 presents a schematic, partially sectional overview of the load unit in one embodiment of the invention. In the figure, the load unit is viewed from the side of the training equipment.

The load unit 2 is presented more closely in FIG. 2 and FIG. 3. The load unit 2 comprises an integral monolithic, i.e. undividable weight 21, at least one actuator with which the load unit is moved along the guideway 3, and a cover 23.

The weight 21 can be any suitable monolithic piece of material, for example any metal, concrete, lead or stone. The weight 21 is integrally and fixedly arranged into the load unit 2, 2*b*.

The actuator 22 or actuators in the embodiment presented in FIG. 2 and FIG. 3 are rolls, more specifically three rolls bearing-mounted on the cover 23 of the load unit with any suitable devices and accustomed manner. The rolls 22 enable the movement of the load unit 2 along the guideway 3. The actuators may also be any other suitable means for moving the load unit 2, such as wheels, a cable, a chain or a belt.

The cover 23 surrounds the weight 21, the parts of a locking device 5 located within the cover 23 and the actuators 22 in such a manner that they are protected from the weather and for example from vandalism. Furthermore, the cover 23 prevents the user from accidentally inserting fingers or other parts between the actuators 22 and the guideway 3 or between the locking device 5 and counterparts 35*a-e* on the guideway 3.

The load unit 2 is moved along the guideway 3 by a locking device 5 arranged onto the load unit 2. The locking device 5 comprises a gripping part 51 or a handle with which the user engages and moves the load unit to a position 35*a*-3 along the guideway 3, the position 35*a-e* corresponding a desired load for the training equipment unit 1.

The locking device 5 further comprises an arm 52 that extends inside of the load unit 2, i.e. into the part of the load unit 2 covered by the cover 23. The locking device 5 is attached pivotably to the cover 23 with an attaching element 53, for example by a pin, screw or bolt that extends through holes arranged into the arm 52 and the cover 23 and that is secured to place either permanently or detachably.

The pivot connection enables two-directional movement of the locking device 5: a first direction engages or fastens the locking device with the guideway 3, and the second, opposite direction removes or releases the locking device 5 from connection with the guideway 3.

The locking device 5 further comprises an end part 54 at the end of the arm 52 located inside the load unit 2. The end part 54 is a connecting part which is connectable with a counterpart 35*a-e* arranged onto the guideway 3 in such a way that the locking device 5 is attached into and removed from a counterpart 35*a-e* when the locking device 5 is pivoted by turning the gripping part 51.

The counterparts 35*a-e* can be holes, notches, indentations or similar machined or otherwise arranged into the guideway 3. The counterparts 35*a-e* are a series of pre-determined locking positions 35*a-e* that each correspond to a desired pre-determined load of the training equipment.

Optionally, the guideway may include markings indicating the load and/or weight each of the counterparts/locking positions 35*a-e* represent, so that the user can get an indication of the load they are employing in the weight training.

The dimensions of the counterparts 35*a-e* correspond to the dimensions of the end part 54 so that secure fastening of the load unit 2 into the guideway 3 is achieved through the connection of the end part 54 and the counterparts 35*a-e*.

The end part 54 and the counterpart 35*a-e* form a form-lock when the load unit 2 is secured into a desired position by turning the gripping part 51 to the first direction. The form-lock is deactivated or unlocked when the locking device 5 is pivoted to the second, opposite direction.

The locking device 5 is spring-loaded to enable automatic securing of the end part 54 to any one counterpart 35*a-e* if the user accidentally or unintentionally tries to set or secure the load unit 2 into a position between two adjacent counterparts 35*a*-3. The spring-loading is achieved in any conventional manner, for example in connection with the attaching element 53.

In another embodiment of the arrangement for adjusting load in training equipment, also presented in FIG. 1, the training equipment unit 1 may comprise two load units 2, 2*a*. In that case, the second load unit 2*b* is arranged onto the moving arm 10, which acts as a second guideway 3*b* for the load unit 2*b* (the guideway 3*b* is not visible in FIG. 1 since it is flush behind the guideway 3).

The moving arm 10 or the second guideway 3*b* is connected to the frame 11 and to the first guideway 3 via a common fulcrum 6. The second guideway 3*b* is arranged to extend to both sides 61, 62 of the fulcrum 6. The two load units 2, 2*b* are separately and independently movable along their respective guideways 3, 3*b*.

The second load unit 2*b*, its structure and operational details, is identical to the load unit 2 described above. Similarly, the second guideway 3*b* corresponds the guideway 3. For example, the second guideway 3*b* also comprises counterparts 35*a-e* which act as a series of pre-determined locking positions 35*a-e* that each correspond to a desired pre-determined load of the training equipment.

Optionally, the guideway 3*b* may also include markings indicating the load and/or weight each of the counterparts/locking positions 35*a-e* represent, so that the user can get an indication of the total load they are employing in the weight training.

The method for adjusting load in training equipment disclosed herein is employed as follows:

The training equipment comprises a frame (11) and a moving arm (10). Together with the guideway 3 the moving arm 10 forms a torque arm or a training arm for the piece of training equipment, and the user can operate this training arm by engaging the handles 14 arranged on the free ends of the moving arm 10 and the guideway 3. The moving arm 11 and the guideway 3 are pivotably connected to the frame 11 via a common fulcrum 6 by a connector 4.

The guideway 3 extends on both sides 61, 62 of the fulcrum 6, and the load unit 2 is arranged on the guideway 3 in such a way that it is freely movable along the guideway 2 on both sides 61, 62 of the fulcrum 6.

The load unit 2 comprises a locking device 5 with which the load unit 2 is moved and secured into a position 35*a-e* corresponding the desired load of the training equipment 1.

The selected load of the training equipment is therefore based on the position 35*a-e* of the load unit 2 and its weight 21 along the guideway 3: the closer to the handles 14 of the training equipment 1 the load unit 2 is positioned, the higher the load becomes, as the torque arm made up by the moving arm 10 and the guideway 3 shortens. Respectively, the farther from the handles 14 the load unit 2 is positioned, the lower the load becomes, as the torque arm becomes longer.

In an alternative embodiment, adjusting the load may also be achieved continuously, i.e. without any pre-determined locking positions 35*a-e* arranged into the guideway 3. Then, a form-lock is formed directly between the end part 54 of the locking device 5 and the guideway 3, which enables a wider range of possible training loads.

In another alternative embodiment where two load units 2, 2*b* are utilized, the two load units 2, 2*b* are separately and independently movable, load unit 2 on guideway 3 and load unit 2*b* on guideway 3*b* (i.e. moving arm 10). Both load units 2, 2*b* are movable on both sides of the fulcrum 6.

The load units 2, 2*b* can be moved to and secured into positions on both sides 61, 62 of the common fulcrum 6. More specifically, load unit 2 may be arranged on the first side 61 and the second load unit 2*b* may be arranged to the second side 62, as is the case in FIG. 1, or vice versa. Alternatively, both load units 2, 2*b* may be positioned on the first side 61 or on the second side 62.

The positioning of the two load units 2, 2*b* will naturally depend on the load the user of the training equipment unit 1 desires to employ in their training. Two load units 2, 2*b* increase the range of possible training loads of the training arrangement unit 1 without affecting the dimensions or space requirements of the training equipment unit 1.

The above-described arrangement and the above-described method are to be understood as only possible embodiments of the arrangement and the method for adjusting load in training equipment. It is to be understood that the arrangement may comprise other parts or alternative assemblies, and that the method may comprise other steps or alternative ways of carrying out the method.

The arrangement for adjusting load can be arranged on any kind of weight training equipment, where a torque arm is employed to move a weight or a load in order to train one's body or parts of the body.

Instead of a single frame 11, the equipment unit 1 can also be arranged as a part of a training stand comprising several pieces of equipment utilizing at least partly the same support or frame structures. Furthermore, instead of a vertical frame 11, the moving arm 10 and the guideway 3 can be arranged onto a wall, column, pillar or any other vertical surface in a pivotable manner.

Instead of a single moving arm 10 the training equipment may also comprise two or more moving arms, connected to each other to form an extended torque arm with pivot points. The torque arm formed by the moving arm 10 and the guideway 3 may enable several different trajectories or paths of movement.

A basic structure, such as the one in the above-described embodiment, may also include different additional structures, pieces or arms for implementing or executing different paths of movement. A training equipment unit may for example include a secondary moving arm and transmitting elements which transmit the load from the primary moving arm or torque arm to the secondary moving arm, in which case the primary moving arm acts as the load unit.

The structure, setup and layout of the moving arm, arms or other functional parts of the training equipment unit will naturally depend wholly on the type of strength training to which it is intended. The basic principle of the present invention remains, however, the same: the load unit 2, 2*b* is movable on both sides 61, 62 of the fulcrum 6 through which the different parts 3, 3*b*, 10, 11 are interconnected by the connector 4.

Instead of fastening the load unit 2, 2*b* into pre-determined positions 35*a-e* arranged onto the guideway 3, 3*b* as holes, indentations, grooves or other such definite locking positions 35*a-e*, to adjust the load in a stepwise manner, the load unit 2, 2*b* can also be arranged to be secured to any desired position along the guideway 3, 3*b* freely selectable for adjusting the load continuously.

The arrangement and method for adjusting load in training equipment according to the invention are especially suitable for outdoor installations, where conditions (weather, wear, infrequent maintenance, vandalism etc.) place certain requirements for the load unit. Since the load unit is fully covered and therefore shielded from outside elements, and since it comprises an integrated monolithic weight with no moving or detachable parts, it is durable and requires very little maintenance. Furthermore, the equipment comprising the arrangement according to the invention is both easy and safe to the user to manipulate, and fulfills the requirements of the European standard EN 16630.

With the disclosed invention, a relatively small change in length of the torque arm causes a significant change in load. Therefore only a short or very limited movement area is needed to achieve a maximum load for an individual user. Hence, that the dimensions of the training equipment, especially perpendicular to the movement of the particular training method can be kept small, and the equipment can be installed in places where only limited space is available.

The specific positioning of the fulcrum in relation to the user's range of movement in each exercise is used to provide a biomechanically optimal and safe resistance curve during the execution of each movement. This resistance curve is individual for each movement and is based on the following facts:

1. the force/length relationship of the skeletal muscles
2. change in the mechanical leverage (referring to the human musculoskeletal system) during any given movement
3. utilization of the potential energy during any given movement (stretch/shortening cycle)
4. effect of fatigue on the force production during a set of repetitions.

The above embodiments are to be understood as illustrative examples of the invention. Further embodiments of the inventions can be conceived. It is to be understood that any feature described herein in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An arrangement for adjusting load in training equipment comprising at least one moving arm pivotably connected to a frame, the arrangement comprising a fulcrum having a first side and a second side, wherein the first side and the second side are defined on opposite sides of the frame, at least one load unit, an elongated guideway extending to either side of the fulcrum and along which the load unit is arranged to move, a locking device with which the load unit is secured into a locking position corresponding to a desired load of the training equipment, and a connector with which the guideway is pivotally connected to the training equipment via the fulcrum, the guideway being connected both to the moving arm and to a frame of the training equipment via the fulcrum, wherein the load unit is movable along the guideway to a locking position in which a center of gravity of the load unit is on the first side of the fulcrum and to a locking position in which the center of gravity of the load unit is on the second side of the fulcrum.

2. The arrangement according to claim 1, wherein the load unit comprises a monolithic weight, at least one actuator with which the load unit is moved along the guideway, and a cover.

3. The arrangement according claim 1, wherein the locking device is arranged directly onto the load unit.

4. The arrangement according to claim 1, wherein the locking device comprises a gripping part for manually moving the load unit along the guideway, an arm arranged to extend inside the load unit through a cover, an attaching element with which the arm is attached pivotably to the cover, and an end part at the end of the arm, the end part attachable into a counterpart of a plurality of counterparts arranged on the guideway.

5. The arrangement according to claim 4, wherein the end part and the counterpart form a form-lock when the load unit is secured into a position.

6. The arrangement according to claim 4, wherein the counterparts are a series of pre-determined locking positions corresponding to the desired load of the training equipment unit.

7. The arrangement according to claim 4, wherein the locking device is spring-loaded so that the end part is automatically secured into one counterpart in case the locking device is unintentionally set into a position between two adjacent counterparts.

8. The arrangement of claim 1, wherein the guideway is pivotably connected to the frame at the fulcrum directly by the connector.

9. The arrangement of claim 1, wherein the guideway and the moving arm share the same fulcrum.

10. A method for adjusting load in training equipment comprising at least one moving arm pivotably connected to a frame, a fulcrum having a first side and a second side, wherein the first side and the second side are defined on opposite sides of the frame, at least one load unit, an elongated guideway extending to either side of the fulcrum through which the guideway and the moving arm are connected to the frame and along which the load unit is arranged to move, a locking device with which the load unit is secured into a locking position corresponding to a desired load of the training equipment, and a connector with which the guideway is connected pivotally to the training equipment via the fulcrum, wherein the load unit is moved on the guideway to a locking position in which a center of gravity of the load unit is on the first side of the fulcrum and to a locking position in which the center of gravity of the load unit is on the second side of the fulcrum.

11. The method according to claim 10, wherein the load unit is secured to one of a plurality of pre-determined locking positions arranged onto the guideway to adjust the load in stepwise manner within the pre-determined locking positions.

* * * * *